US005242654A

United States Patent [19]

Ward et al.

[11] Patent Number: 5,242,654

[45] Date of Patent: Sep. 7, 1993

[54] PRODUCTION OF FLAT PRODUCTS

[75] Inventors: Robert F. Ward, Chester, England; Nigel J. Brooks, Holywell, Wales

[73] Assignee: Mixalloy Limited, Rhydymwyn, England

[21] Appl. No.: 825,597

[22] Filed: Jan. 27, 1992

[30] Foreign Application Priority Data

Feb. 2, 1991 [GB] United Kingdom ..... 9102290

[51] Int. Cl.[5] ..... B22F 3/16

[52] U.S. Cl. ..... 419/36; 419/38; 419/43; 419/45; 419/53; 419/54; 419/57

[58] Field of Search ..... 419/36, 45, 53, 54

[56] References Cited

U.S. PATENT DOCUMENTS

| | | | |
|---|---|---|---|
| 4,391,772 | 7/1983 | Bonner et al. | 419/23 |
| 4,617,054 | 10/1986 | Mathers | 75/246 |
| 4,622,189 | 11/1986 | Bellis et al. | 264/112 |
| 4,722,826 | 2/1988 | Poole | 419/11 |
| 4,836,980 | 6/1989 | Kashiwadani et al. | 419/36 |
| 5,011,654 | 4/1991 | Mathers | 419/3 |
| 5,015,289 | 5/1991 | Toda et al. | 75/229 |
| 5,080,712 | 1/1992 | Jamps et al. | 75/229 |
| 5,098,648 | 3/1992 | Kiyota et al. | 419/23 |
| 5,108,492 | 4/1992 | Kiyota et al. | 75/246 |
| 5,132,080 | 7/1992 | Pfeil | 419/2 |

FOREIGN PATENT DOCUMENTS

| | | |
|---|---|---|
| 0176200 | 2/1986 | European Pat. Off. . |
| 1212681 | 11/1970 | United Kingdom . |
| 1301093 | 12/1972 | United Kingdom . |
| 1360486 | 7/1974 | United Kingdom . |

*Primary Examiner*—Peter A. Nelson
*Assistant Examiner*—Daniel Jenkins
*Attorney, Agent, or Firm*—Kinney & Lange

[57] ABSTRACT

A process for producing strip products which comprises forming an aqueous slurry of a suspension of metallic particles in a film forming cellulose derivative, depositing a quantity of the slurry onto a support surface, drying the slurry to form a self supporting flat product, removing the dried product from the support surface and roll compacting the same to produce a green strip. The green strip is supported on a moving surface as it travels to and enters a heater in which it is heated in an oxidising atmosphere to a temperature at which substantially all traces of the cellulose derivative are removed. The heated strip is fed while still on the moving support surface to and through a sinter furnace to form a coherent strip of the required composition.

6 Claims, 2 Drawing Sheets

PRODUCTION OF FLAT PRODUCTS

FIELD OF THE INVENTION

This invention relates to the production of flat products such as strip or sheet (hereinafter referred to simply as "strip") from a start material consisting essentially of metallic and/or non-metallic particles.

It is known from GB-PS-1360486, GB-PS-1301093, GB-PS-1212681 AND EP 0176200 to produce strip from metal powder in which a coating of a slurry comprising a suspension of metal powder in a cellulose derived binder composition is deposited onto a support surface, the slurry being heated to gel the binder and drive-off excess water, removed from the support surface and compacted to form a green strip. The green strip is then subjected to heat treatment in a reducing atmosphere within a furnace to cause the particles to coalesce to form a coherent strip product. During its travel through the sinter furnace the strip is conveniently supported on a moving endless belt, the speeds of the strip and the belt being substantially the same.

In the production of certain strip products including carbide forming elements, such as those to be used in welding and brazing applications, a carbon level of below 0.1% by weight is required. Indeed, welding grade austenitic stainless steels typically require a maximum carbon level of 0.02% by weight.

In the process described above, the binder composition is typically methyl cellulose. The retention of this binder in the strip product typically increases the final carbon content of products including significant amounts of carbide forming elements to 0.05% to 0.15% by weight above the initial carbon content of the particulate material from which the strip is to be produced. Such retention has, hitherto, been considered necessary to provide the green strip with sufficient strength and integrity for handling purposes until the conclusion of the sintering process. Removal of the binder tends to produce a brittle green strip which breaks if subjected to stress.

SUMMARY OF THE INVENTION

The present invention sets out to provide a process for producing flat products by a process as generally described above in which relatively low final carbon contents can be achieved which closely match or are below the initial carbon content of the particulate material from which the strip is to be produced.

According to the present invention in one aspect there is provided a process for producing strip products which comprises forming an aqueous slurry of a suspension of metallic particles in a film forming cellulose derivative, depositing a quantity of the slurry onto a support surface, drying the slurry to form a self supporting flat product, removing the dried product from the support surface and roll compacting the same to produce a green strip, supporting the green strip on a moving surface as it travels to and enters a heater, heating the green strip while in the heater in an oxidising atmosphere to a temperature at which substantially all traces of the cellulose derivative are removed, and feeding the heated strip while still on the moving support surface to and through a sinter furnace to form a coherent strip of the required composition.

DESCRIPTION OF A PREFERRED EMBODIMENT OF THE INVENTION

Figure 1:
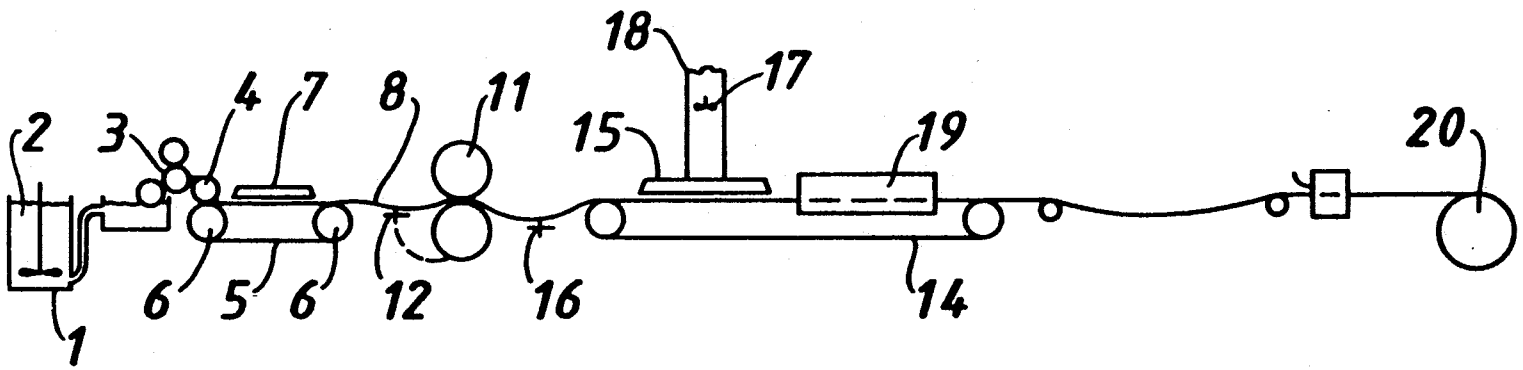
Figure 2:
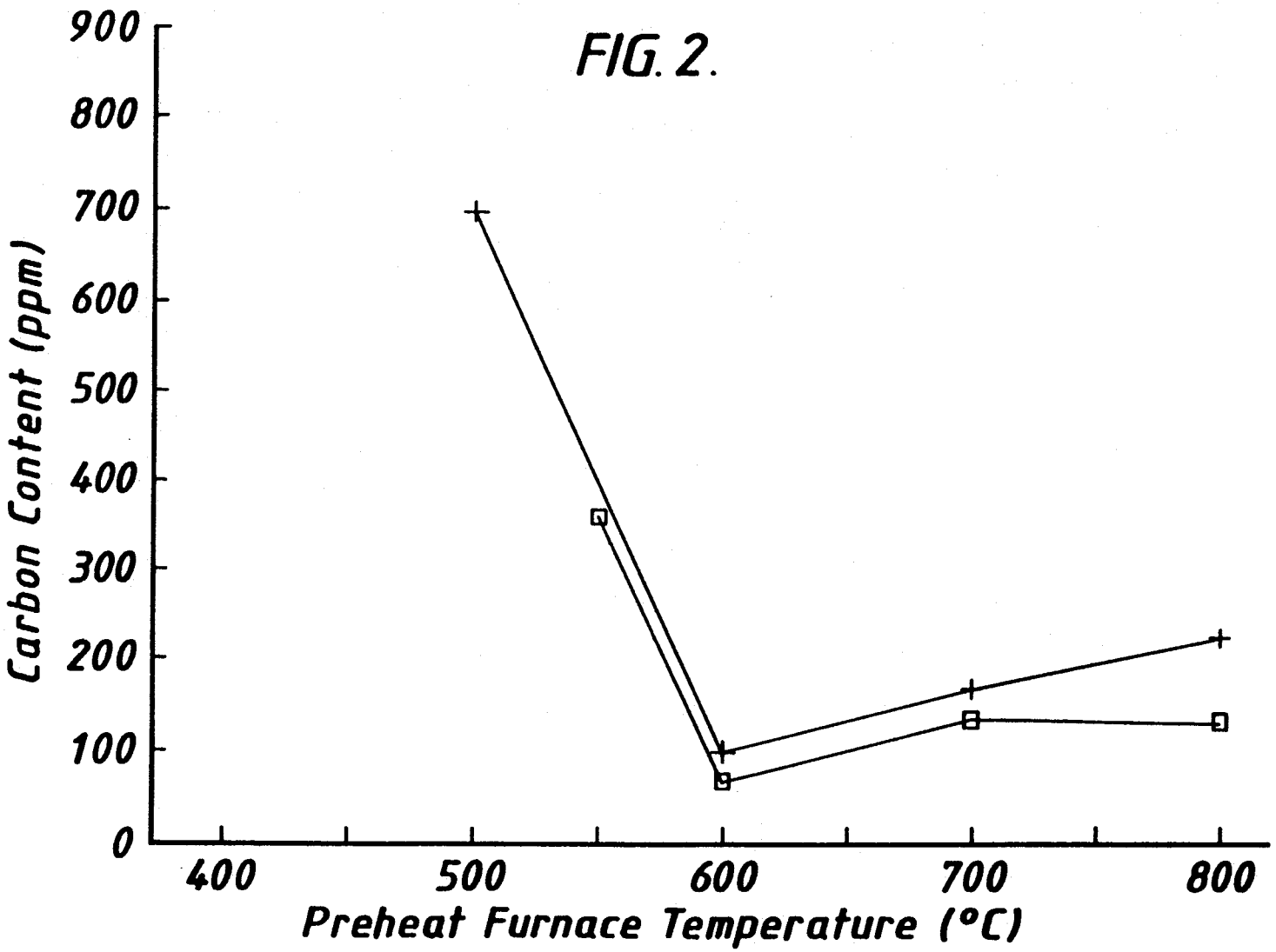

The invention will now be described by way of example only with reference to the accompanying diagrammatic drawing in which:

FIG. 1 is a schematic side view partly in section of apparatus for operating a process in accordance with the invention; and FIG. 2 is graph in which carbon content (ppm) is plotted against furnace temperature.

In the apparatus illustrated in FIG. 1, a slurry 2 is retained within a vessel 1. The slurry conveniently is based upon methyl cellulose treated with glyoxal as a solubility inhibiter together typically with water optionally containing suitable slurrying and wetting agents. Incorporated in the aqueous methyl cellulose is a powder mix typically of below 80 BS mesh. The concentration of the metal powder in the aqueous slurry is typically approximately 75% by weight although lower or higher concentrations may be used according to the mechanical and/or thermal properties which are required.

The powder may be produced by any conventional means, these including gas or water atomisation.

The slurry is transferred by way of a train of rollers 3 onto a coating roller 4 arranged to deposit a slurry coating of a selected thickness and width onto an endless moving belt 5 looped around drums 6. The belt is preferably constructed of an inert material such as stainless steel. Other means of slurry deposition, for example, curtain coating or extrusion may be employed.

The drive applied to at least one of the drums 6, feeds the belt 5 through a drying oven 7 initially to raise the temperature of the deposited slurry layer to about 45° C. to promote gelling of the methyl cellulose and to drive water from the gelled slurry. The slurry film emerges from the drying oven 7 as a flexible and self supporting strip 8 which can readily be removed from the surface of the belt 5, the latter being conveniently treated to ensure effective release. The flexible self supporting strip is generally referred to as "flexi-strip".

The flexi-strip passes to the nip of a pair of contra rotating rolls 11 in which it is compacted. The speed of rotation of the rolls 11 is controlled to ensure that the amount of flexi-strip present between the belt 5 and rolls 11 does not exceed a predetermined value. A sensor 12 is positioned below a loop of the flexi-strip as it approaches the rolls 11 to detect the presence of excessive strip, the rotational speed of the rolls 11 being controlled in response to the sensor to maintain a predetermined loop formation.

On leaving the nip of the rolls 11 the flexi-strip is fed onto a second moving endless belt 14 produced from an inert material such as stainless steel and is transported to and through a heater 15. A sensor 16 is positioned below a loop of the compacted flexi-strip as it approaches the belt 14 to detect and compensate for the presence of excessive strip. The entry and exit openings of the heater are of a height to minimise heat losses whilst ensuring a steady flow of air through the heater, this flow being encouraged by a fan 17 located in an outlet vent 18 of the heater. An additional fan may be provided, this being located in an outlet vent of the heater. The heater is typically of the radiant-type and includes a plurality of heating panels spaced at intervals of, say, 2 to 6 inches.

As the strip passes through the heater, the carbon content of the methyl cellulose is oxidised and leaves the heater via the vent 18 as carbon monoxide and carbon dioxide. The temperature existing within the heater is typically between 400° and 800° C. and the time of travel of strip through the heater is typically between 20 and 180 seconds. The temperature and strip speed (typically between 2 and 20 meters/minute) are essentially set at levels which ensure substantially complete removal from the strip of all traces of the methyl cellulose binder used in the formation of the slurry.

The strip is then transmitted by the belt into and through a sinter furnace 19.

The sintered strip leaving the furnace is then coiled on a coiler 20 prior to compaction and further heat treatments.

The graph illustrated in FIG. 2 is taken from a trial in which a 308 L chromium-nickel austenitic stainless steel strip was treated by the process described above, it being resident in the heater 15 for a period of 120 seconds and in the furnace 19 for a period 180 seconds. As will be seen from the graph, the initial carbon contact (700 ppm) reduced significantly with temperature.

The process described is applicable to the production of strip products for which a low carbon content is required (typically between 0.005% by weight and 0.10% by weight) and in which a relatively high oxygen content is not a disadvantage. Typical strip products include those used in welding and brazing applications and may, for example, comprise welding grade austenitic stainless steels and nickel based alloys.

It is to be understood that the foregoing is merely exemplary of processes in accordance with the present invention and that modifications can readily be made without departing from the true scope of the invention as defined by the appended claims.

We claim:

1. A process for producing strip products which comprises forming an aqueous slurry of a suspension of metallic particles in a film forming cellulose derivative, depositing a quantity of the slurry onto a support surface, drying the slurry to form a self supporting flat product, removing the dried product from the support surface and roll compacting the same to produce a green strip, supporting the green strip on a moving surface as it travels to and enters a heater, heating the green strip while in the heater in an oxidising atmosphere to a temperature at which substantially all traces of the cellulose derivative are removed, and feeding the heated strip while still on the moving support surface to and through a sinter furnace to form a coherent strip of the required composition.

2. A process as claimed in claim 1 wherein the slurry comprises an aqueous solution of methyl cellulose and metallic powder.

3. A process as claimed in claim 2 wherein the deposited slurry is heated to a temperature approximating to 45° C. to promote gelling of the methyl cellulose and to drive water from the gelled slurry.

4. A process as claimed in claim 1 wherein the heater comprises one or more radiant heater panels operable to maintain within the heater a temperature of between 400° C. and 800° C.

5. A process as claimed in claim 4 wherein the residence time of strip within the heater is between 20 and 180 seconds.

6. An austenitic stainless steel strip product having a carbon content of between 0.005% and 0.10% by weight produced by a process as claimed in claim 1.

* * * * *